US007607707B2

(12) United States Patent
Eising et al.

(10) Patent No.: US 7,607,707 B2
(45) Date of Patent: Oct. 27, 2009

(54) LOAD HOOK

(75) Inventors: Ralf Eising, Bochum (DE); Udo Gersemsky, Herdecke (DE); Uwe Lichtenvort, Essen (DE); Thilo Walloschek, Witten (DE)

(73) Assignee: Demag Cranes & Components GmbH, Wetter (DE)

( * ) Notice: Subject to any disclaimer, the term of this patent is extended or adjusted under 35 U.S.C. 154(b) by 406 days.

(21) Appl. No.: 11/615,084

(22) Filed: Dec. 22, 2006

(65) Prior Publication Data

US 2007/0176446 A1 Aug. 2, 2007

(30) Foreign Application Priority Data

Dec. 24, 2005 (DE) ..... 10 2005 062 333

(51) Int. Cl.
*B66C 1/36* (2006.01)

(52) U.S. Cl. ..... 294/82.1; 294/82.19; 294/131

(58) Field of Classification Search ..... 294/26, 294/82.1, 82.11, 82.17, 82.19, 131
See application file for complete search history.

(56) References Cited

U.S. PATENT DOCUMENTS 921,286 A * 5/1909 Saunders ..... 294/82.19
931,270 A * 8/1909 Clarkson ..... 59/95
1,525,090 A * 2/1925 Rutan ..... 294/82.16
2,553,133 A * 5/1951 Conner ..... 198/682
3,092,412 A * 6/1963 Drake ..... 294/66.1
4,017,111 A * 4/1977 Sandnes ..... 294/82.19
4,708,382 A * 11/1987 LaCount ..... 294/82.1
6,193,432 B1 * 2/2001 Kampfert ..... 403/321
6,694,574 B1 * 2/2004 Sheng ..... 24/265 H

FOREIGN PATENT DOCUMENTS

| | | | |
|---|---|---|---|
| DE | 298 17 206 | U1 | 3/2000 |
| DE | 102005023990 | A1 | 2/2006 |
| DE | 2004034590 | B3 | 4/2006 |
| EP | 1454870 | A2 | 9/2004 |
| EP | 1616836 | A2 | 1/2006 |
| EP | 2039948 | A1 | 3/2009 |

OTHER PUBLICATIONS

French search report from corresponding French Patent Application No. 0655504, dated May 26, 2009, by DB Recherche.

* cited by examiner

*Primary Examiner*—Dean J Kramer
(74) *Attorney, Agent, or Firm*—Van Dyke, Gardner, Linn & Burkhart, LLP

(57) ABSTRACT

The invention concerns a load hook with a hook fastened to a hook tackle that can be safely handled. A cover region is arranged at least partially between the hook tackle and the hook, such that the hook is covered starting at the outer contour of the hook tackle.

11 Claims, 1 Drawing Sheet

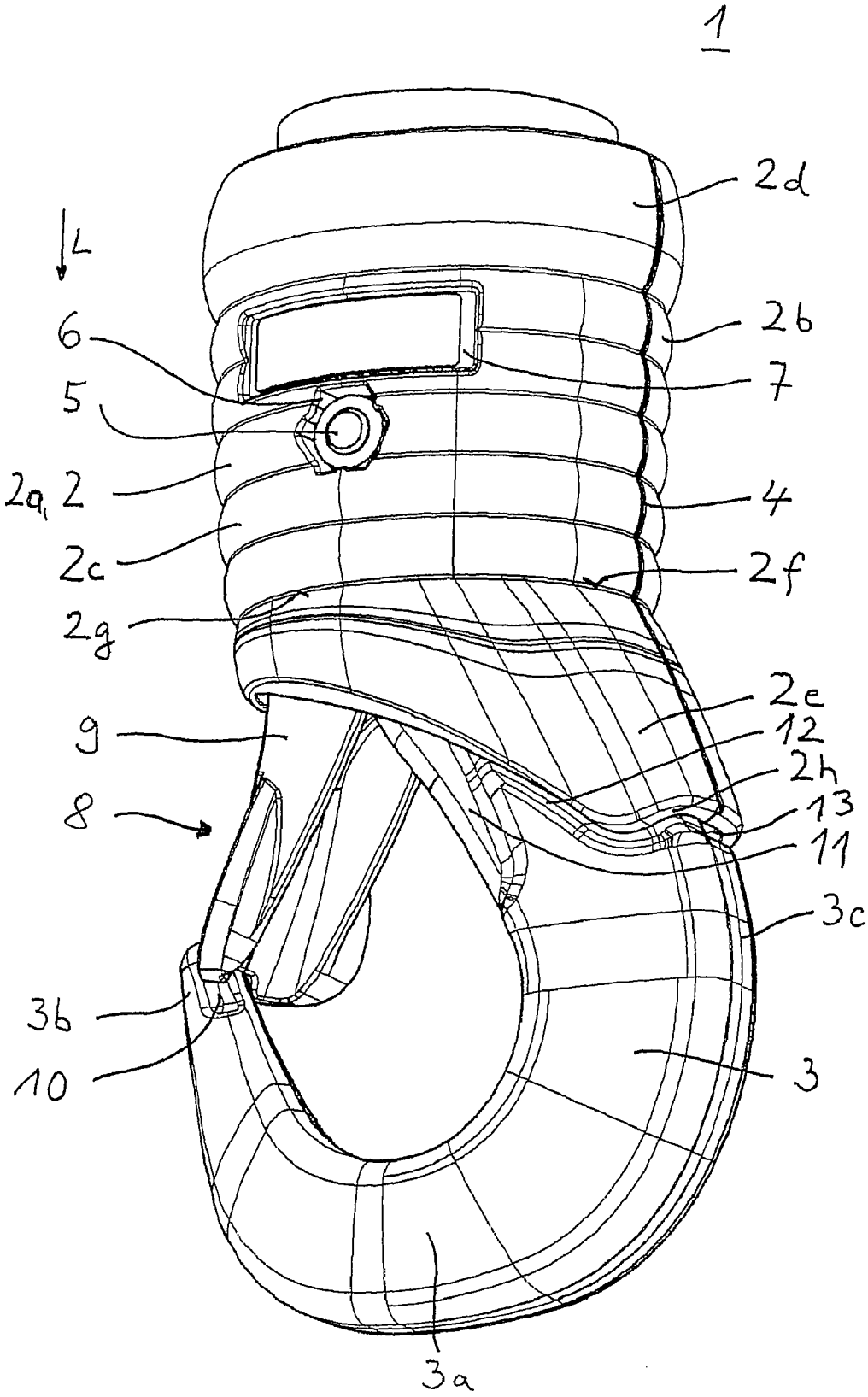
1
2d
L
2b
6
7
5
2a, 2
4
2c
2f
2g
2e
9
12
2h
8
13
11
3c
3b
10
3
3a

LOAD HOOK

The invention concerns a load hook with a hook fastened to a hook tackle.

BACKGROUND OF THE INVENTION

A load hook is known from German utility model DE 298 17 206 U1, being attached by a chain to a hoisting machine. The load hook is composed in familiar manner of a hook to take up the load and a hook-supporting housing known as the hook tackle, by which the hook is connected to the chain. The hook tackle is divided into two halves in the lengthwise direction of the load hook and has a barrel-shaped appearance. The two halves of the hook tackle are joined together by two screws running transversely to the lengthwise direction of the hook. In the screwed-together condition, the flat parting planes of the halves of the hook tackle lie against each other. In the region of the flat parting planes, in the lengthwise direction of the load hook, an upper and a lower recess are provided, each of which emerges through adjacent upper and lower opening regions into the top and the bottom of the hook tackle. The load hook is form-fitted in the lower recess and the chain, via a holding piece, in the upper recess. In keeping with the barrel shaped form of the hook tackle, this load hook has a largely planar bottom side. Arranged centrally in the bottom side is the opening region for the hook, especially for its cylindrical shaft. In the lengthwise direction of the hook, the outer diameter of the load hook narrows abruptly or in step-like manner from the hook tackle to the shaft of the hook. Accordingly, the bottom side of the hook tackle is ring shaped and the shaft of the hook extends centrally outward from the bottom side of the hook tackle.

With this ring-shaped bottom side, the load hook can easily get stuck on other, primarily projecting pieces of loads during their handling. From this position, then, as the chain is further slackened, the load hook can slip off and get detached, resulting in sudden loading of the hoist and a swaying of the load. Furthermore, especially in the case of rather small load hooks, the size of the hook tackle may be inadequate for an operator to grab it safely and without it slipping off when hooking on or unhooking a load or manipulating a load.

Therefore, the underlying problem solved by the invention is to create safer load hooks that can be safely handled.

SUMMARY OF THE INVENTION

According to the invention, a load hook includes a hook fastened to a hook tackle. A secure construction that is safe to handle is achieved in that a cover region is at least partially arranged between the hook tackle and the hook, such that the hook is partly covered starting at the outer contour of the hook tackle. This configuration will create a larger grasping surface for the manual holding or pulling forces applied by a user, such as when using the hands. The larger bearing surface prevents the user's hand from slipping off with a concomitant uncontrolled swaying of the load hook. Thus, there is less risk of injury. Furthermore, the hand cannot slip off and get injured by the step-like transition zone, since this is covered. Neither can the load hook get easily caught or stuck.

In another embodiment, the cover region adjoins the lower end facing the hook in the manner of at least a ring segment, and it covers the hook at least partly in the region of the back side of the hook, opposite the opening of the hook.

An alternative embodiment specifies that the cover region adjoins the lower end facing the hook in the manner of a ring, and also covers the hook in the region of the back side of the hook, opposite the opening of the hook. A hook mouth securement is arranged in the opening region of the hook. Thus, the handling of the hook is safe in regard to protection of the hands.

Since the user's ball of the thumb usually grasps the back side of the hook, it is provided that the length of the cover region increases from the hook mouth securement to the back side of the hook, in the lengthwise direction of the hook. This configuration further increases the bearing surface for the hand.

Optionally, the hook may be stationary relative to the hook tackle. Thus, the lengthened cover region can be easily adapted to the position of the hook.

Optionally the cover region and the hook tackle may form a single piece.

To achieve a gentle transition between hook and hook tackle, avoiding abrupt contours, the cover region may taper, starting at the outer contour of the lower end of the hook tackle in the region of the hook, toward the outer contour of the hook, and its back side opposite the opening of the hook.

The end of the cover region away from the hook tackle dips at least partly into a recess-like constriction arranged in the back side away from the opening of the hook.

The invention shall be described more closely hereafter by means of a sample embodiment represented in the single FIGURE.

BRIEF DESCRIPTION OF THE DRAWINGS

FIG. 1 is a perspective view of a load hook 1 according to the invention, showing a number of ancillary lines to assist in the three-dimensional representation of the load hook 1.

DETAILED DESCRIPTION OF PREFERRED EMBODIMENTS

The load hook 1 comprises a hook tackle 2 and a hook 3. The hook tackle 2 here has the usual function of a connection element, in order to suspend the hook 3 from a chain or cable (not shown). A design for a chain shall be assumed. The hook tackle 2 also has a housing function, making it possible to accommodate and enclose the ends of the hook 3 and of the chain, facing each other.

In the present embodiment of the load hook 1, the hook tackle 2 is divided in the lengthwise direction L of the load hook 1, i.e., in the vertical direction for a load hook 1 hanging freely from a chain, into a first half 2*a* and a second half 2*b*. The partition occurs in the middle, so that the halves 2*a* and 2*b* are basically the same size. Furthermore, the halves 2*a* and 2*b* each have generally flat parting planes 4, and when assembled together they complement each other to form a barrel-shaped or cylindrical body. In addition, the hook tackle 2 is provided with a contoured grasping region 2*c* on the outside, comprising an outwardly bulging and adjoining annular region in the lengthwise direction L of the load hook 1. Thus, a basically corrugated grasping region 2*c* is produced. However, the valleys of the corrugation are very inconspicuous.

The grasping region 2*c* is adjoined on top by an end region 2*d* which, like the grasping region 2*c*, comprises an outwardly bulging annular region in the lengthwise direction L of the load hook 1. However, the end region 2*d* is longer in the lengthwise direction L of the load hook 1 than one annular region of the grasping region 2*c*. Also, end region 2*d* has a larger diameter than an annular region of the grasping region 2*c*. This configuration ensures that the user's hand grasping the load hook 1 can feel the end of the hook tackle 2. Thus, the user can brace himself against it with his hand.

The end 2*g* of the grasping region 2*c* away from the end region 2*d* is adjoined at the bottom by a cover region 2*e*, which extends in the lengthwise direction L of the load hook 1 and has the form of a sleeve-like shell. This shell, or cover region 2*e*, has at its upper end 2*f* the approximate outer contour of the lower end 2*g* of the grasping region 2*c* of the hook tackle 2. Starting at this point, the outer contour of the cover region 2*e* changes in the direction of the outer contour of the hook 3, or that of a hook mouth securement 9, which is present in the region of the hook 3. In the present case, the cover region 2*e* tapers or contracts in the direction of the outer contour of the hook 3. The transition between the hook 3 or the hook mouth securement 9 and the hook tackle 2, including the grasping region 2*c*, thus becomes streamlined, i.e., for the most part free of step-like or abrupt transitions. Thus, because the grasping region 2*c* is lengthened in the lengthwise direction of the load hook 1, the user's hand can safely grasp the load hook 1, even in the case of a small load hook. For example, the ball of the user's thumb can grasp the lengthened grasping region.

Preferably, the hook tackle 2 and the cover region 2*e* are formed as a single piece. The cover region 2*e* can also be mounted on the hook tackle 2 with form fitting or by screwing or gluing.

If necessary, the cover region 2*e* may also comprise a ring segment extending along a portion of the circumference of the end 2*g* of the hook tackle 2 near the hook. This portion is preferably arranged away from the opening 8 of the hook 3, i.e., facing the back side 3*c* of the hook 3.

It is also possible to configure the hook tackle 2 as a single piece. However, in such a configuration, the hook 3 and the end of the chain on the hook 3 must be fastened in a different manner. For example, a fastening can then occur by securing the end of the hook 3 and the chain using securing rings in corresponding boreholes in the hook tackle 2.

In the case of the load hook 1 shown in the single FIGURE, the T-shaped end of the shaft of the hook 3 (not shown) and the end of the chain are form-fitted inside the halves 2*a*, 2*b* of the hook tackle 2 and are firmly enclosed by them. The T-shaped end of the shaft of hook 3 and the end of the chain are inserted with form fitting in corresponding recesses provided in the parting plane 4 of one of the two halves 2*a*, 2*b*. The other of the two halves 2*a*, 2*b* with parting plane 4 and corresponding recesses is then placed thereon. The two halves are firmly joined together by a connector 5, which is fashioned here as a hexagonal head screw with hexagonal nut. The connector 5, including its head and nut, are countersunk in suitable recesses 6 in the grasping surface 2*c*. The recesses 6 and the adjoining borehole (not shown) for the connector 5 are each arranged centrally in each half 2*a*, 2*b*. Above the respective recess 6, there is another rectangular recess 7, serving to affix the product's nameplate, which does not protrude beyond the grasping surface 2*c*.

As explained above, the hook 3 adjoins the hook tackle 2 at the bottom. The hook 3 comprises a hook shaft (not shown) and an adjoining, generally u-shaped hook mouth 3*a*, at the end of which is the hook tip 3*b*. The straight hook shaft, as described above, is received by its end with form fitting in the hook tackle 2 and emerges centrally from the lower end 2*g* of the hook tackle 2. In keeping with the barrel shape of the hook tackle 2, the lower end of the hook tackle 2 is generally planar in configuration, but the apronlike cover region 2*e* is then adjacent to the lower end of the hook tackle 2 in the edge region.

The hook 3 is arranged in the hook tackle 2 free of twisting. Rotation of the load hook 1 about lengthwise axis L can be achieved by a fastening of the chain to the hook tackle 2, such that the load hook 1 can turn about the lengthwise axis L.

Furthermore, as shown in the FIGURE, the sleeve-like cover region 2*e* has different lengths in the lengthwise direction L of the load hook 1, such that the lower end of the cover region 2*e* is slanted when viewed from the side. In the region of the opening 8 of the hook mouth 3*a*, therefore, the cover region 2*e* is at its shortest. Cover region 2*e* increases in the direction of the back side 3*c* of the hook 3, away from the opening 8 of the hook mouth 3*a*, and reaches its maximum length in the middle of the hook mouth 3*a*. Cover region 2*e* then decreases slightly toward the back side 3*c* of the hook 3.

The single FIGURE also shows that the cover region 2*e* is at least partly let into the surface of the hook 3 in the segment where the hook 3 is covered. The hook 3 has a recessed constriction 12 in the region of its hook mouth 3*a*, passing as a slight step shape into the surface of the rest of the hook mouth 3*a*. At this point, the edge 2*h* of the hook 3 facing the hook 3 projects slightly above the outer surface of the hook 3. Thus, the transition can be easily felt by the user of the load hook 1, but is not so conspicuous or large as to hinder the use of the load hook. A flush or level shape may also be provided for the transition. Furthermore, a gap 13 remains between the hook 3 and the cover region 2*e*, so that the cover region 2*e* and the hook 3 are uncoupled from each other. The lower side of the cover region 2*e* can be slightly spaced away from the hook, and the constriction 12.

A portion of a hook mouth securement 9 is also covered by the cover region 2*e*. This hook mouth securement 9 serves in usual fashion to close the opening 8 of the hook mouth 3*a*. The hook mouth securement 9 can swivel from a closed position inward into an open position in the opening 8 of the hook mouth 3*a*. The swivel axis is located at roughly the height of the shaft of the hook 3 in the lengthwise direction L of the load hook 1. Furthermore, notches 10 are provided on the inside of the tip 3*b*, facing the opening 8, into which the free end of the hook mouth securement 9 is inserted in the closed position. Recesses 11 are also provided on the inside of the hook mouth 3*a*, enabling a further opening of the hook mouth securement 9, such that parts thereof can dip into the surface of the hook mouth securement 9.

The invention claimed is:

1. A load hook, comprising:

a hook fastened to a hook tackle, wherein the hook is stationary relative to the hook tackle and the hook tackle comprises an outer contour;

a cover region at least partially arranged between the hook tackle and the hook to cover a portion of the hook starting at the outer contour of the hook tackle;

wherein the cover region adjoins a lower end of the hook tackle facing the hook in the manner of a ring, said cover region covering the hook in the region of a back side of the hook opposite an opening of the hook, including a hook mouth securement arranged in the opening region of the hook; and wherein the length of the cover region increases from the hook mouth securement to the back side of the hook, in the lengthwise direction of the load hook.

2. The load hook per claim 1, wherein the cover region and the hook tackle form a single piece.

3. The load hook per claim 2, wherein the cover region tapers, starting at the outer contour of a lower end of the hook tackle in the region of the hook, toward the outer contour of the hook at the back side of the hook opposite the opening of the hook.

4. The load hook per claim 3, wherein the end of the cover region away from the hook tackle dips at least partly into a recess-like constriction arranged in the back side away from the opening of the hook.

5. The load hook per claim 1, wherein the end of the cover region away from the hook tackle dips at least partly into a recess-like constriction arranged in the back side away from the opening of the hook.

6. The load hook per claim 1, wherein the cover region tapers, starting at the outer contour of a lower end of the hook tackle in the region of the hook, toward the outer contour of the hook at the back side of the hook opposite the opening of the hook.

7. A load hook, comprising:

a hook fastened to a hook tackle, wherein the hook is stationary relative to the hook tackle and the hook tackle comprises an outer contour;

a cover region at least partially arranged between the hook tackle and the hook to cover a portion of the hook starting at the outer contour of the hook tackle;

wherein the cover region and the hook tackle form a single piece; and wherein the cover region tapers, starting at the outer contour of a lower end of the hook tackle in the region of the hook, toward the outer contour of the hook at the back side of the hook opposite the opening of the hook.

8. The load hook per claim 7, wherein the end of the cover region away from the hook tackle dips at least partly into a recess-like constriction arranged in the back side away from the opening of the hook.

9. A load hook, comprising:

a hook fastened to a hook tackle, wherein the hook is stationary relative to the hook tackle, and the hook tackle comprises an outer contour at a lower end thereof in the region of the hook;

a cover region at least partially arranged between the hook tackle and the hook to cover a portion of the hook starting at the outer contour of the hook tackle;

wherein the cover region tapers, starting at the outer contour of the lower end of the hook tackle in the region of the hook, toward the outer contour of the hook at the back side of the hook opposite the opening of the hook; and wherein the end of the cover region away from the hook tackle dips at least partly into a recess-like constriction arranged in the back side away from the opening of the hook.

10. The load hook per claim 9, wherein the cover region and the hook tackle form a single piece.

11. A load hook, comprising:

a hook fastened to a hook tackle, wherein the hook is stationary relative to the hook tackle, and the hook tackle comprises an outer contour at a lower end thereof in the region of the hook;

a cover region at least partially arranged between the hook tackle and the hook to cover a portion of the hook starting at the outer contour of the hook tackle;

wherein the cover region adjoins a lower end of the hook tackle facing the hook in the manner of at least a ring segment, said cover region at least partially covering the hook in the region of a back side of the hook opposite an opening of the hook;

wherein the cover region tapers, starting at the outer contour of a lower end of the hook tackle in the region of the hook, toward the outer contour of the hook at the back side of the hook opposite the opening of the hook; and wherein the end of the cover region away from the hook tackle dips at least partly into a recess-like constriction arranged in the back side away from the opening of the hook.

* * * * *